US011378097B2

(12) United States Patent
Svarre et al.

(10) Patent No.: US 11,378,097 B2
(45) Date of Patent: Jul. 5, 2022

(54) MULTISTAGE CENTRIFUGAL PUMP

(71) Applicant: GRUNDFOS HOLDING A/S, Bjerringbro (DK)

(72) Inventors: Erik Bundesen Svarre, Bjerringbro (DK); John Frigård Nielsen, Fårup (DK); Finn Ulrich Storgaard, Bjerringbro (DK); Iraj Babazadeh, Hjortshøj (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 428 days.

(21) Appl. No.: 15/355,800

(22) Filed: Nov. 18, 2016

(65) Prior Publication Data

US 2017/0146029 A1 May 25, 2017

(30) Foreign Application Priority Data

Nov. 19, 2015 (EP) ..... 15195415

(51) Int. Cl.

| | |
|---|---|
| ***F04D 1/06*** | (2006.01) |
| ***F04D 29/62*** | (2006.01) |
| ***F04D 29/42*** | (2006.01) |
| ***F04D 29/041*** | (2006.01) |
| ***F04D 13/02*** | (2006.01) |
| ***F04D 17/08*** | (2006.01) |
| ***F04D 25/02*** | (2006.01) |
| ***F04D 29/043*** | (2006.01) |
| ***F04D 29/046*** | (2006.01) |
| ***F04D 29/053*** | (2006.01) |
| ***F04D 29/056*** | (2006.01) |
| ***F04D 29/10*** | (2006.01) |

(52) U.S. Cl.

CPC ..... *F04D 29/624* (2013.01); *F04D 1/06* (2013.01); *F04D 13/02* (2013.01); *F04D 17/08* (2013.01); *F04D 25/02* (2013.01); *F04D 29/043* (2013.01); *F04D 29/046* (2013.01); *F04D 29/0416* (2013.01); *F04D 29/053* (2013.01); *F04D 29/056* (2013.01); *F04D 29/102* (2013.01); *F04D 29/106* (2013.01); *F04D 29/426* (2013.01); *F04D 29/4206* (2013.01); *F04D 29/628* (2013.01); *F05D 2230/72* (2013.01)

(58) Field of Classification Search

CPC ..... F04D 17/122; F04D 17/12; F04D 17/08; F04D 29/62; F04D 1/06; F04D 13/02

USPC ..... 417/350, 244; 415/199.2

See application file for complete search history.

(56) References Cited

U.S. PATENT DOCUMENTS 1,900,531 A * 3/1933 Vitu ..... F04D 1/06 415/100

3,088,416 A 5/1963 Danis (Continued)

FOREIGN PATENT DOCUMENTS

CN 1140239 A 1/1997

DE 22 04 892 A1 8/1972

(Continued)

*Primary Examiner* — Woody A Lee, Jr.

*Assistant Examiner* — Wesley Le Fisher

(74) *Attorney, Agent, or Firm* — McGlew and Tuttle, P.C.

(57) ABSTRACT

A multi-stage centrifugal pump includes a pump casing, in which a shaft (8) carrying an impeller is rotatably arranged. The pump casing has a pump casing foot part (2) that includes a reversibly closable maintenance opening (60), via which a bearing and/or seal (20, 25), which is arranged at a shaft end within the pump casing, is accessible and exchangeable.

20 Claims, 7 Drawing Sheets

(56) References Cited

U.S. PATENT DOCUMENTS 3,671,138 A * 6/1972 Ball ..... F04D 1/006 415/101
4,057,371 A * 11/1977 Pilarczyk ..... F01D 25/166 417/409
4,722,662 A 2/1988 Morgan
4,927,339 A * 5/1990 Riffe ..... F04C 18/023 418/109
5,201,633 A * 4/1993 Peu ..... F04D 1/066 137/565.33
5,380,162 A * 1/1995 Evans, II ..... F04D 7/08 417/223
5,388,971 A * 2/1995 Kobayashi ..... F04D 29/406 417/423.14
5,616,013 A * 4/1997 Kobayashi ..... F04D 1/06 415/182.1
5,846,052 A * 12/1998 Kameda ..... F04D 1/06 415/182.1
5,857,841 A * 1/1999 Kobayashi ..... F04D 1/006 417/350
5,888,053 A * 3/1999 Kobayashi ..... F04D 1/06 417/244
6,309,174 B1 * 10/2001 Oklejas, Jr. ..... F04D 29/051 415/104
6,498,410 B1 * 12/2002 Yashiro ..... F04D 19/048 310/90
7,828,530 B2 * 11/2010 Queirel ..... E04H 4/1245 417/247
7,866,944 B2 * 1/2011 Kenyon ..... A61M 16/0057 415/199.2
7,946,810 B2 * 5/2011 Towsley ..... F04D 1/063 415/198.1
8,172,523 B2 * 5/2012 Towsley ..... F04D 1/063 415/198.1
8,517,012 B2 * 8/2013 Daly ..... A61M 16/0057 128/204.18
8,632,320 B2 * 1/2014 Palomba ..... F04D 29/286 417/247
8,893,499 B2 * 11/2014 Maier ..... F02G 1/00 60/647
10,077,783 B2 * 9/2018 Masuda ..... F04D 17/125
10,082,155 B2 * 9/2018 Mikkelsen ..... F04D 1/06
10,094,385 B2 * 10/2018 Mikkelsen ..... F04D 17/12
10,094,388 B2 * 10/2018 Keller ..... F04D 29/056
2002/0114713 A1 * 8/2002 Wang ..... F04D 29/0413 417/365
2006/0269404 A1 * 11/2006 Volk ..... F04D 1/063 415/198.1
2008/0080988 A1 * 4/2008 Wahl ..... F04D 29/588 417/365
2008/0267763 A1 * 10/2008 Wahl ..... F04D 29/0416 415/4.5
2010/0284829 A1 * 11/2010 Sloteman ..... F04D 9/003 417/199.1
2018/0038389 A1 * 2/2018 Nakaniwa ..... B01D 45/16

FOREIGN PATENT DOCUMENTS

DE 695 20 343 T2 10/2001
DE 696 29 606 T2 6/2004
DE 600 26 446 T2 11/2006
EP 0719940 B1 3/2001

* cited by examiner

MULTISTAGE CENTRIFUGAL PUMP

CROSS REFERENCE TO RELATED APPLICATIONS

This application claims the benefit of priority under 35 U.S.C. § 119 of European Application 15 195 415.3 filed Nov. 19, 2015, the entire contents of which are incorporated herein by reference.

FIELD OF THE INVENTION

The invention relates to a multistage centrifugal pump with a pump casing and with a shaft which carries the impellers of the pump stages and which is rotatably arranged within the pump casing.

BACKGROUND OF THE INVENTION

Centrifugal pumps of this type and in numerous variants are counted as belonging to the state of the art. In this context, Grundfos pumps (of the Applicant) of the CR series, or Lowara X pumps (of the Xylem concern) of the SV-series are referred to. Such multi-stage centrifugal pumps comprise a common shaft, which carries impellers of pump stages and which is rotatably arranged within a pump casing. Thereby, the drive, in particular with pumps of a larger construction type, is mostly effected via an external motor which is drive-connected to the pump shaft via a coupling. Such pumps are often envisaged for operation with a vertical shaft, and the pump casing therefore comprises a foot part forming the placement surface of the centrifugal pump, as well as a head part designed as a motor stool or comprising such, on which the drive motor is fastened. The pump stages are integrated between the head part and the foot part which are often at least partly manufactured from cast metal, and these pump stages are closed off by a peripheral jacket and are connected to one another via tie rods amid the inclusion of the pump stages. If the centrifugal pump is designed as an inline pump, then on the foot part side it comprises a suction connection and a delivery connection which are offset by 180° to one another. The fluid entering into the pump via the suction connection and running through the individual pump stages is led upwards in each case amid the increase of pressure, where in the head part it is led again to the foot part via an annular channel formed between diffusers and the outer casing, and there to the delivery connection. The shaft carrying the impellers is led out at the motor-side end in a sealed manner. It is counted as belonging to the state of the art, to apply a sealing cartridge in this region, in order to be able to exchange the seal in a quick and simple manner in the case of wear. A bearing can be provided at the other end of the shaft, thus the end which is located within the pump casing. It is also counted as belonging to the state of the art to subject this shaft end to the pressure of the delivery side, in order to hydraulically compensate the axial forces acting upon the shaft. It is then regularly necessary to provide a seal in this region.

It always requires a certain amount of effort to exchange a seal, a bearing or both in the case of a defect or wear, irrespective of whether these are present individually or both are present. The pump is to be dismantled in large parts for this. The tie rods and further components are to be removed, in order to be able to exchange the bearing and/or the seal at the casing-side end, thus in the region of the foot part. This work is time-consuming and is thus expensive.

SUMMARY OF THE INVENTION

Against this background, it is an object of the invention, to design a generic multistage centrifugal pump such that the previously mentioned repair and maintenance work is simplified, without the manufacturing costs of the pump being significantly increased by way of this.

The multi-stage centrifugal pump according to the invention comprises a pump casing, in which a shaft is rotatably mounted, said shaft carrying impellers of the pump stages. The pump casing comprises a reversibly closable maintenance opening, via which a shaft end cooperating part, a bearing which is arranged within the pump casing at the shaft end and/or a seal which is arranged within the pump casing at the shaft end, is accessible and exchangeable.

A basic concept of the solution according to the invention, it to provide a maintenance opening within the pump casing, typically at the base side, said opening only being opened for maintenance purposes and being sealingly closed on remaining operation, but permitting the control, the maintenance or, as the case may be, the exchange of wear-sensitive components on the shaft end (wear-sensitive shaft end cooperating parts) located within the pump casing, be they a bearing and/or seal, in a targeted manner, without having to dismantle the complete pump, in particular without having to release the tie rods, for this. Such an additional maintenance opening as a rule can be provided with little expense with regard to manufacturing technology, and one merely needs only to provide a component closing this opening, as the case may be amid the integration of a seal, which with regard to the design is mostly possible without any problem. The maintenance opening, as the case may be, can be opened and closed again several times, due to the fact that the maintenance opening is reversibly closable.

The maintenance opening, in particular if it is arranged on the foot part which is mostly designed as a cast component, can be formed by a simple recess in the base. Such an opening in the simplest form can be closed by a screw-fastened cover. Thereby, it can either be the case of a cover which encompasses (overlaps) the opening and which is fastened by way of fastening screws engaging into the respective casing component laterally of the opening, or however it can be the case of a cover which comprises a thread on its outer periphery, said thread engaging into an inner thread of the opening. The first variant is advantageous with regard to the cost and is simple to seal, by way of a flat seal being integrated between the components or by providing an O-ring with the provision of a cover seal-side or casing-side groove.

Means for blocking the rotation movement of the shaft are advantageously to be provided, in order to be able to exchange the bearing parts or seal parts which are fastened on the shaft end, for example by way of a screw connection. These means do not necessarily have to be provided on this shaft end, but for example can also be provided on the head of the pump outside the casing, if for example the shaft there has a square or hexagonal profile, onto which a spanner can be placed. A suitable profile for the engagement of a tool can alternatively also be provided at the free shaft end within the casing or, or a transverse bore in the shaft end, through which a blocking pin can be placed.

It is advantageous to arrange the maintenance opening in the base of the pump casing, if the centrifugal pump is designed for operation with a vertically arranged shaft. However, multi-stage centrifugal pumps which are designed for operation with a horizontally arranged shaft are also known. With these pumps too, it is advantageous to incorporate the maintenance opening in a casing wall in a manner aligned to the shaft, and specifically at the side of the casing which is away from the motor, thus on a wall of the casing which is remote from the motor.

Basically, it is useful to place the maintenance opening such that the bearing and/or the seal at the shaft end is/are easily accessible. This can be effected by a lateral opening in the casing. However, it is particularly useful for the opening to be aligned to the shaft. Aligned to the shaft is not to be understood in the strict geometric sense, but the opening can also be aligned to the shaft, thus to the shaft axis, in a slightly offset manner, depending on which is more favorable with regard to the design.

It is particularly advantageous if the cover not only has a purely closing function, but simultaneously fulfils further functions. Thus according to a further development of the invention, the cover can comprise a part which passes through the opening and which receives or forms a rotationally fixed part of the seal or of the bearing. Such an arrangement has the advantage that on removal of the cover, not only is an access to the seal or the bearing at the free shaft end created, but at the same time a part of the seal or of the bearing is formed or is held. Then specifically, a part of the bearing or of the seal is also disassembled already after the disassembly of the cover, which on the one hand simplifies the examining of the condition and on the other hand also simplifies the exchange in the case of a repair. It is then advantageous if the other part of the seal or of the bearing is releasably fastened on the shaft end which is arranged within the pump casing. Thereby, the co-rotating part for example can be fastened by way of a screw engaging into a threaded bore of the shaft end or be placed onto the shaft end and be fixed there by way of a nut.

It is usually necessary to block the shaft, in order to prevent a co-rotation, for the release of such a screw connection. This in the simple case can be envisaged by a profile which is incorporated on the led-out shaft end, or a transverse bore through the shaft. Basically, it is also conceivable for blocking means to be provided on the motor shaft.

If the cover according to a further development of the invention is designed such that it overlaps the maintenance opening and is screw-fastened on the pump casing in the overlapping part, then this can be sealed in a simple manner, e.g. by way of a flat seal. The assembly and disassembly is configured in a simple manner, since the screws as a rule are easily accessible given a suitable alignment of the pump. Such an arrangement is then advantageous, in particular if the cover assumes further functions such as for example carrying the stationary part of the bearing or of the seal, since one can ensure adequately large contact surfaces, in order to ensure the required exact alignment of the components to one another. Moreover, the machining of the casing around the cover opening as well as the formation of threaded bores or stud bolts which are provided there can be manufactured in the same chucking on the machine tool. The cover itself can be formed of sheet metal or of cast metal.

It is particularly advantageous to arrange the maintenance opening within the foot part, preferably on the base side, if the centrifugal pump is designed as an inline pump, whose suction and delivery connections are arranged on the foot part side. Thereby, the centrifugal pump advantageously comprises an axial seal at the shaft end, the stationary part of said axial seal comprising a ring which is arranged in an axially movable manner within the pump casing or within a component integrated therein. Such a design, with which on the one hand a hydraulic pressure impingement of the free shaft end is formed for the compensation of the axial forces acting on the pump shaft and on the other hand a low-friction, but effective axial seal which is less prone to wear is formed, is particularly advantageous. This axial seal can be controlled, overhauled and exchanged in a rapid and simple manner by way of the maintenance opening. Thereby, the stationary part of the axial seal which is axially movably mounted within the pump casing is mounted in the cover, with which the maintenance opening is closed.

The invention is hereinafter explained in more detail by way of embodiment examples represented in the drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
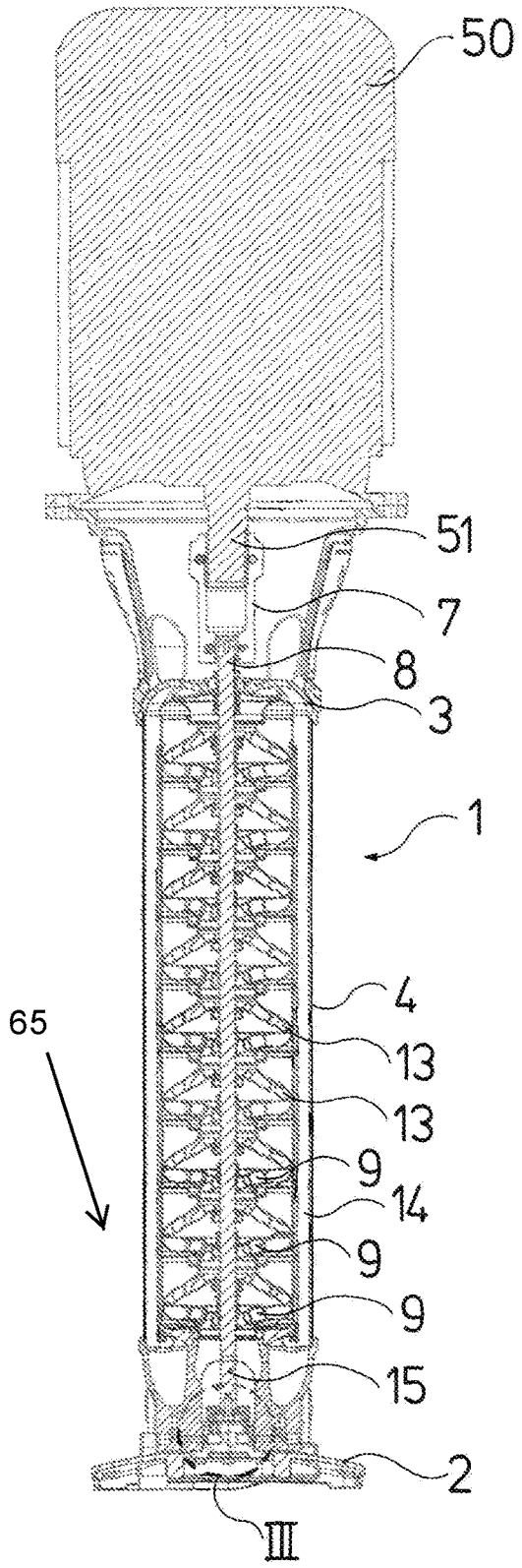
FIG. 1 is a greatly simplified schematic, longitudinal, sectional view through a multi-stage centrifugal pump of the inline construction type with a drive motor.
Figure 2:
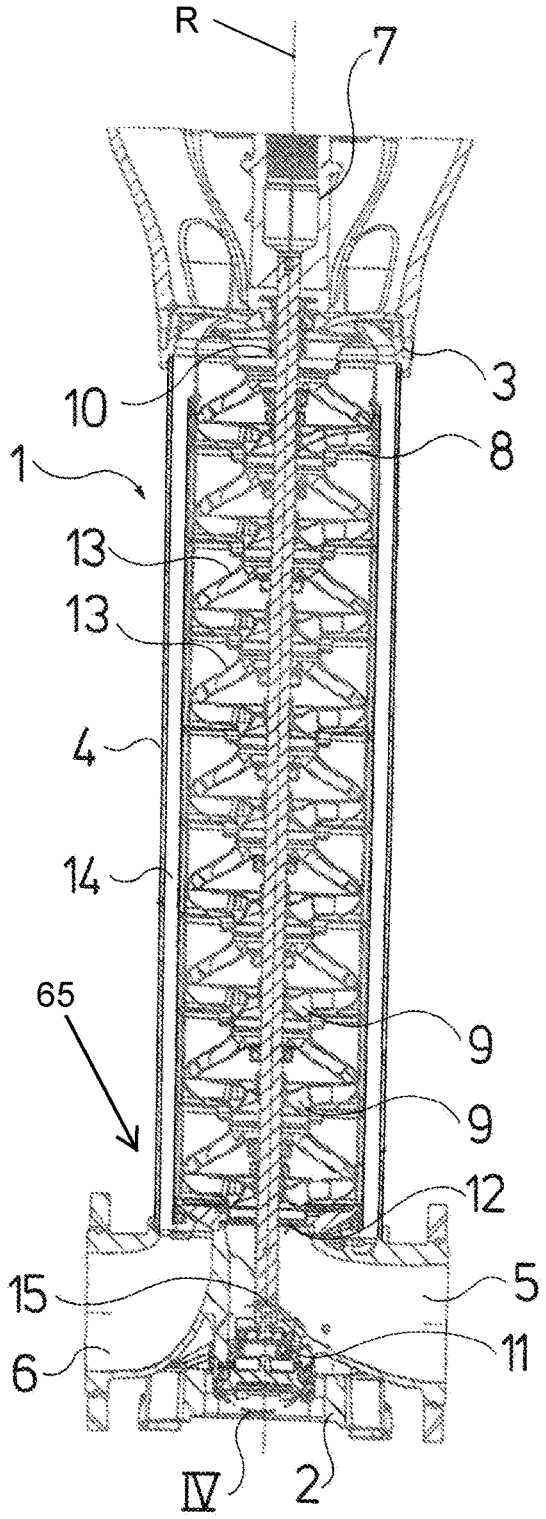
FIG. 2 is an enlarged, longitudinal, sectional view of the pump which is rotated by 90° with respect to FIG. 1.
Figure 3:
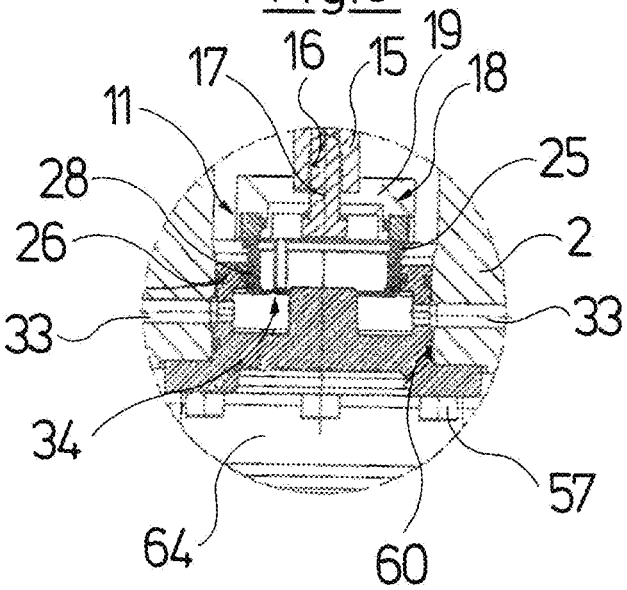
FIG. 3 is an enlarged representation showing the detail III in FIG. 1.
Figure 4:
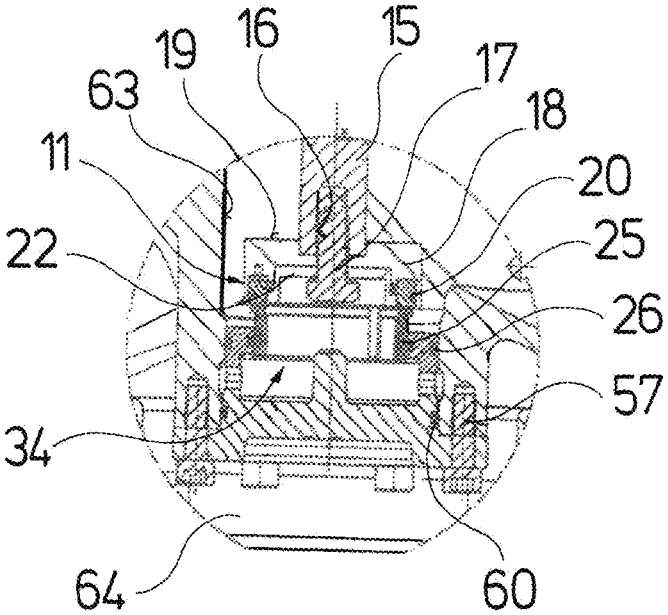
FIG. 4 is an enlarged representation showing the detail IV in FIG. 2.
Figure 5:
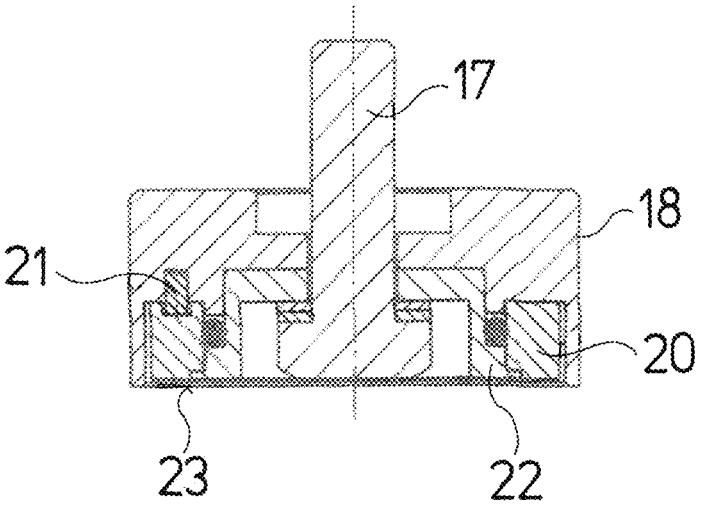
FIG. 5 is a longitudinal, sectional view showing the rotating part of the axial seal.
Figure 7:
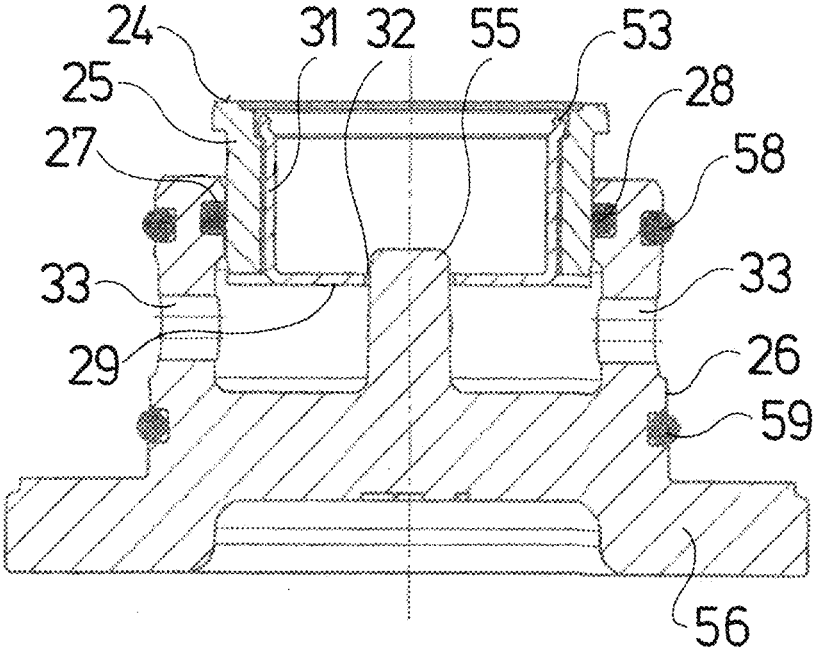
FIG. 7 is a longitudinal, sectional view showing the non-rotating part of the axial seal with a holding ring for integration into the pump casing.
Figure 6:
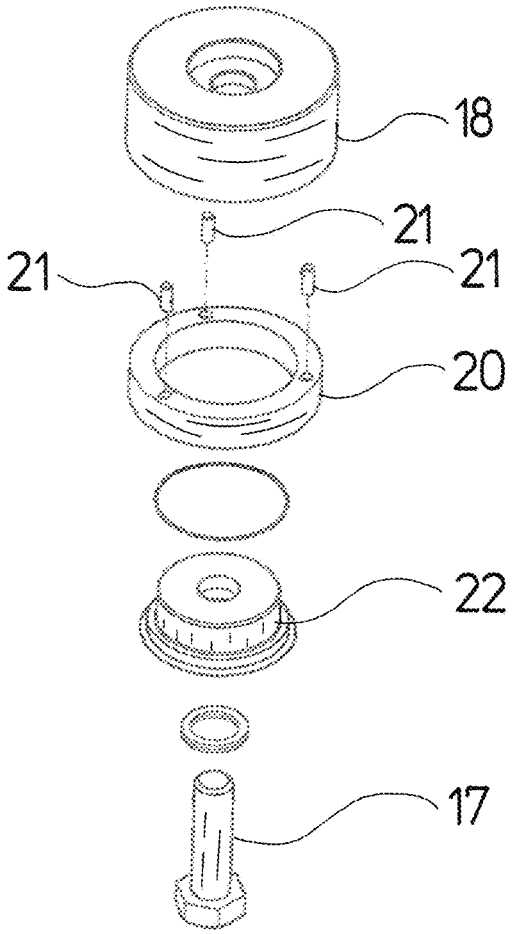
FIG. 6 is an exploded representation showing the components of the rotating part of the axial seal.
Figure 8:
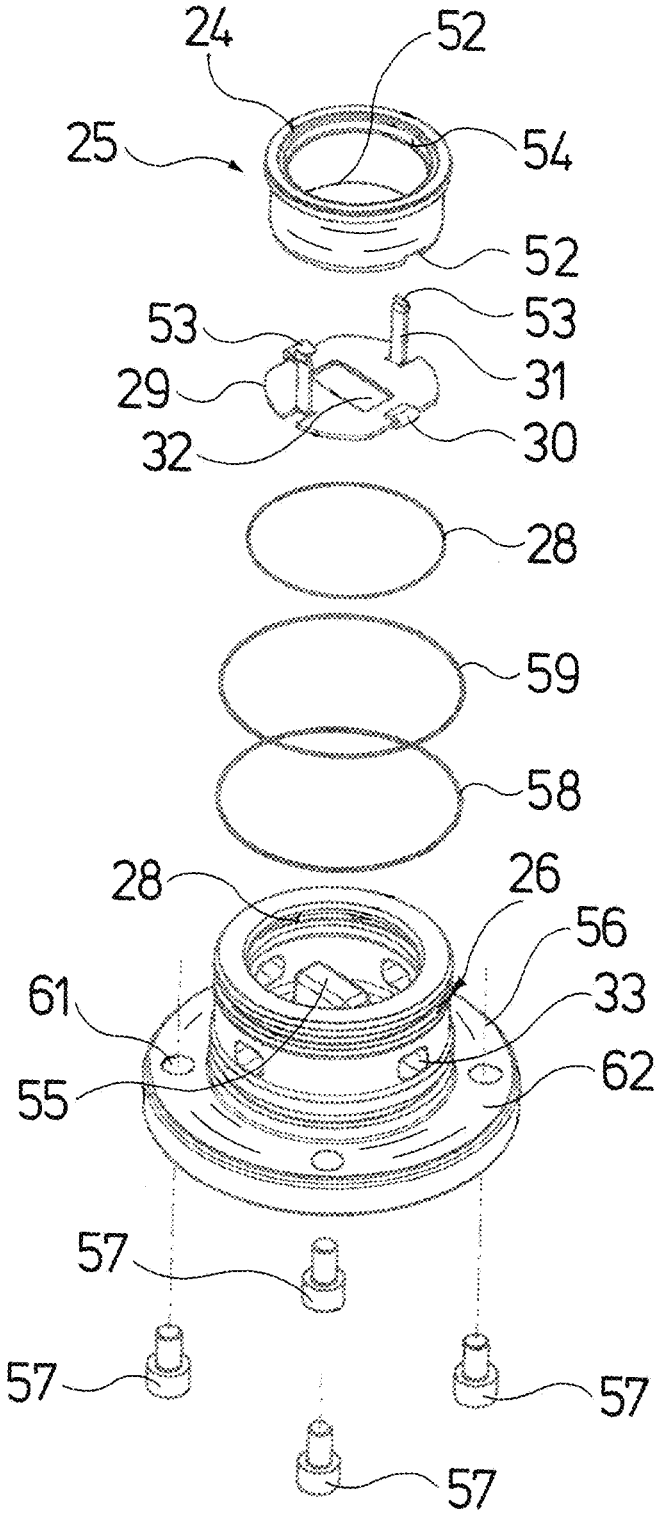
FIG. 8 is an exploded representation showing the components of the non-rotating part of the axial seal.

With the centrifugal pump which is represented by way of FIGS. 1-10 it is the case of a multi-stage centrifugal pump 1 of the inline construction type which is operated in a standing manner. The pump casing (housing) 65 comprises a foot part 2, a head part 3 and a cylindrical jacket 4 which is arranged therebetween and which surrounds the pump stages and is clamped between the head part 3 and the foot part 2. The foot part 2 comprises a suction connection 5 as well as, aligned to this, a delivery connection 6. The head part 3 is designed as a motor stool and surrounds a coupling 7 which connects a shaft 51 of an electric motor 50 schematically represented in FIG. 1 and attached on the head part 3, to a shaft 8 of the pump 1 in a rotationally fixed manner. The shaft 8 of the pump 1 carries the impellers 9 of the pump stages and is rotatably arranged within the pump casing such that the shaft rotates about an axis R. A radial seal 10 is provided in the head part 3, and an axial seal 11 is provided in the foot part 2. The construction of this axial seal 11 is evident in detail from the FIGS. 3 to 8 and is described in a detailed manner further below. Fluid is brought into the pump casing on operation via the suction connection 5, when the shaft 8 rotates, and this fluid enters into the suction port 12 of the first pump stage and is delivered through the pump stages which are formed in each case by an impeller 9 and a surrounding diffuser 13, until it exits from the last pump stage in the head part 3 and is led back via an annular channel 14 to the delivery connection 6, through which the fluid leaves the pump again.

The casing-side shaft end 15 of the pump in the region of the suction port 12 lies below the first pump stage. It comprises a pocket-hole bore 16 which is provided with a thread and in which a cap screw 17 is seated, with which cap screw a holding ring 18 is sealingly and fixedly fastened on the shaft end 15. The holding ring 18 comprises a wall 19 which is directed to the suction port 12 and is closed with the exception of a central recess for leading through the screw 17, thus is designed in a pot-like manner and is fixedly connected to the shaft end 15 in a sealed manner.

The holding ring 18 is designed as a turned part, is stepped to the side which is away from the shaft end 15 and is formed with a peripheral groove which is open to the bottom and which is provided for receiving a rotating ring 20. The rotating ring 20 consist of silicon carbide and is rotationally secured in the holding ring 18 by way of pins 21 and is otherwise fastened together with the holding ring 18 on the shaft end 15, by way of a sleeve 22 which radially encompasses the rotating ring 20 on the inner side and by way of the screw 7. The rotating ring 20 comprises a downwardly directed axial surface 23 thus which is directed away from the shaft end 15 and this surface forms the rotating axial surface of the axial seal 11. This axial surface 23 is not completely planar, but comprises three macroscopic prominences which are uniformly distributed over the periphery and which on the one hand form a defined contact on the counter-surface 24, which is to say on the axial surface 24 of the non-rotating axial seal part 25, and on the other hand serve for the rapid build-up of the lubricative film. The axial surface 24 is designed in a planar manner and is part of the non-rotating part, here of the ring 25 which is arranged in an axially movable manner within a holding ring 26 integrated in a corresponding receiver in the lower side of the foot part 2 of the pump casing.

The holding ring 26 comprises a peripheral groove 27 on its inner side, in which groove an O-ring 28 is integrated, said O-ring radially sealing the ring 25 with respect to the holding ring 26 and thus with respect to the pump casing. The holding ring 26 is moreover yet sealed with respect to the receiver in the pump casing by way of an outer-peripheral seal 58, as is evident from the sectioned representations 4 and 7.

The non-rotating ring 25 at the rear side which is away from the axial sealing surface 24 is covered by a sheet metal section 29 which almost completely covers this rear side of the sealing ring 25. The sheet-metal section 29 comprises bent-over tongues 30, with which the sheet metal section is integrated within corresponding recesses 52 on the rear side of the ring 25 with a positive fit. These tongues 30 project radially beyond the ring 25 and engage into these recesses 52 in the ring 25 and form part of a rotation lock of the non-rotating ring 25. Moreover, the sheet-metal section 29 comprises two diametrically opposite tongues 31 which are offset by 90° to the tongues 30 and which are bent away upwards out of the plane of the main material by 90° and connect the sheet-metal section 29 in an axially distanced manner to the ring 25, in which the ends 53 engage into a shoulder 54 on the inner side of the ring 25 in a locking manner.

The sheet-metal section 29 forms a closed surface of the lower side of the ring 25 and comprises a central rectangular recess 32, into which a pin 55 which is rectangular in cross section engages, said pin forming part of the holding ring 26, on which the ring 25 comprising the axial sealing surface 24 is guided in a rotationally fixed, but axially movable manner. The pin 55 and the recess 32 with regard to cross section are dimensioned such that this recess 32 with the pin 55 located therein, together with any gap tolerances of the sheet-metal section 29 form a through-gap with a cross-sectional area which is significantly smaller than the cross-sectional area of channels 33 which are provided in the foot part 2 of the pump casing or in the holding ring 26 and which ensure that the interior 34 of the ring 25 with the sheet-metal section 29 and the holding ring 26 is subjected to the pressure of the delivery side of the pump, thus to the pressure at the delivery connection 6. These channels 33, on starting up the pump after an effected pressure build-up ensure that the sheet-metal section 29 with the ring 25 bearing thereon is firstly subjected to force and is pushed, in the direction of the free shaft end, thus towards the motor, since firstly fluid must flow via the smaller cross section of the gap between the recess 32 and the pin 55, into the space enclosed by the ring, before a corresponding counter-pressure is built up. The ring 25 is moved axial upwards in FIG. 1, which is to say is moved axially within the holding ring 26 by way of this, until the axial surface 24 bears on the counter-surface 23, by which means a separation between the suction-side space in the region of the shaft end 15 and the installation space 34 of the stationary part of the axial seal 11 is then also formed. The pressure of the delivery side also prevails within the ring 25 and this at the face side of the shaft 8, as soon as the space which is enclosed by the ring 25 and the sheet-metal section 29 has filled via the gap of the recess 32, by which means the certain force compensation with regard to the hydraulically caused axial force of the shaft 8 and which is desired on operation is effected.

Figure 9:
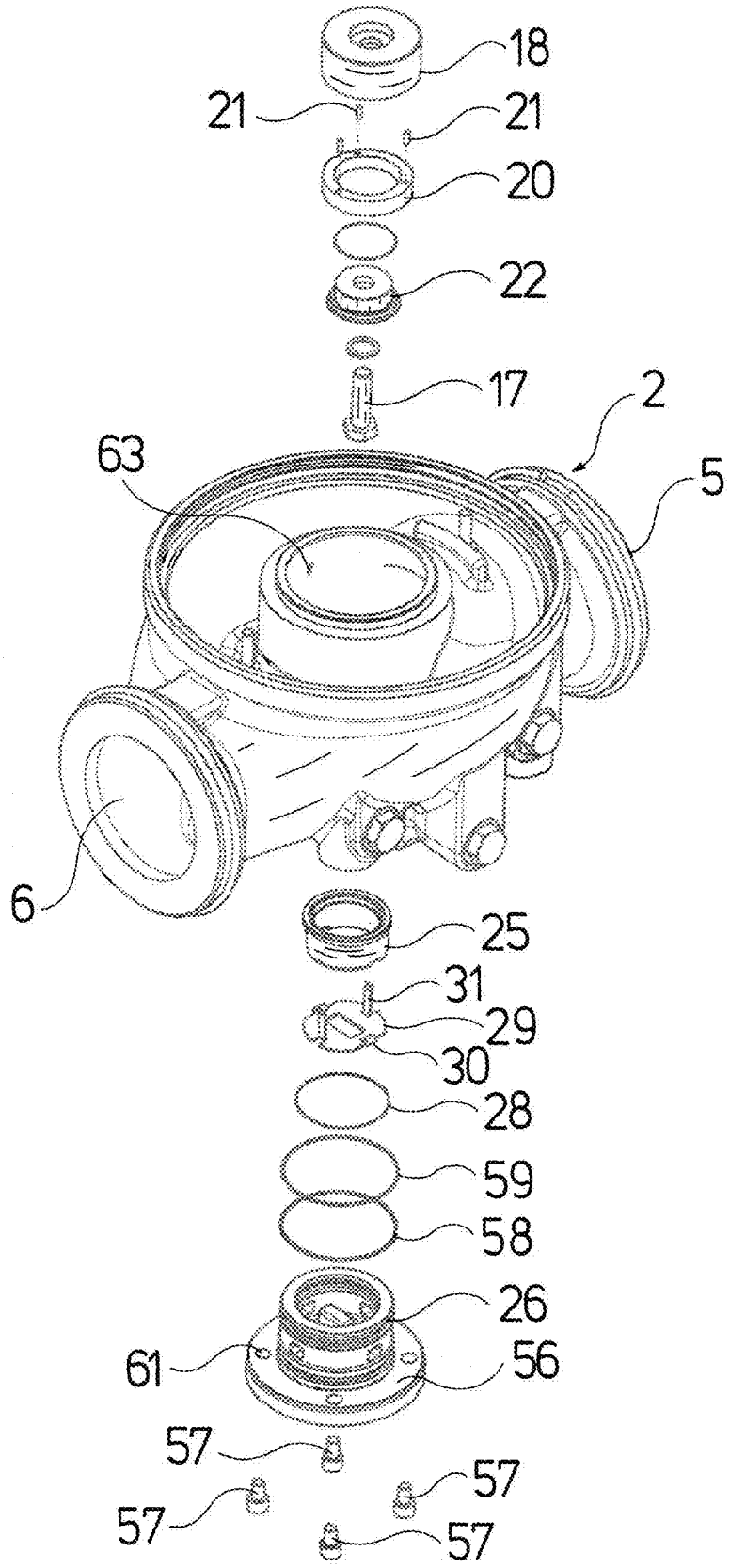
FIG. 9 is an exploded representation showing the axial seal and the foot part of the centrifugal pump.
Figure 10:
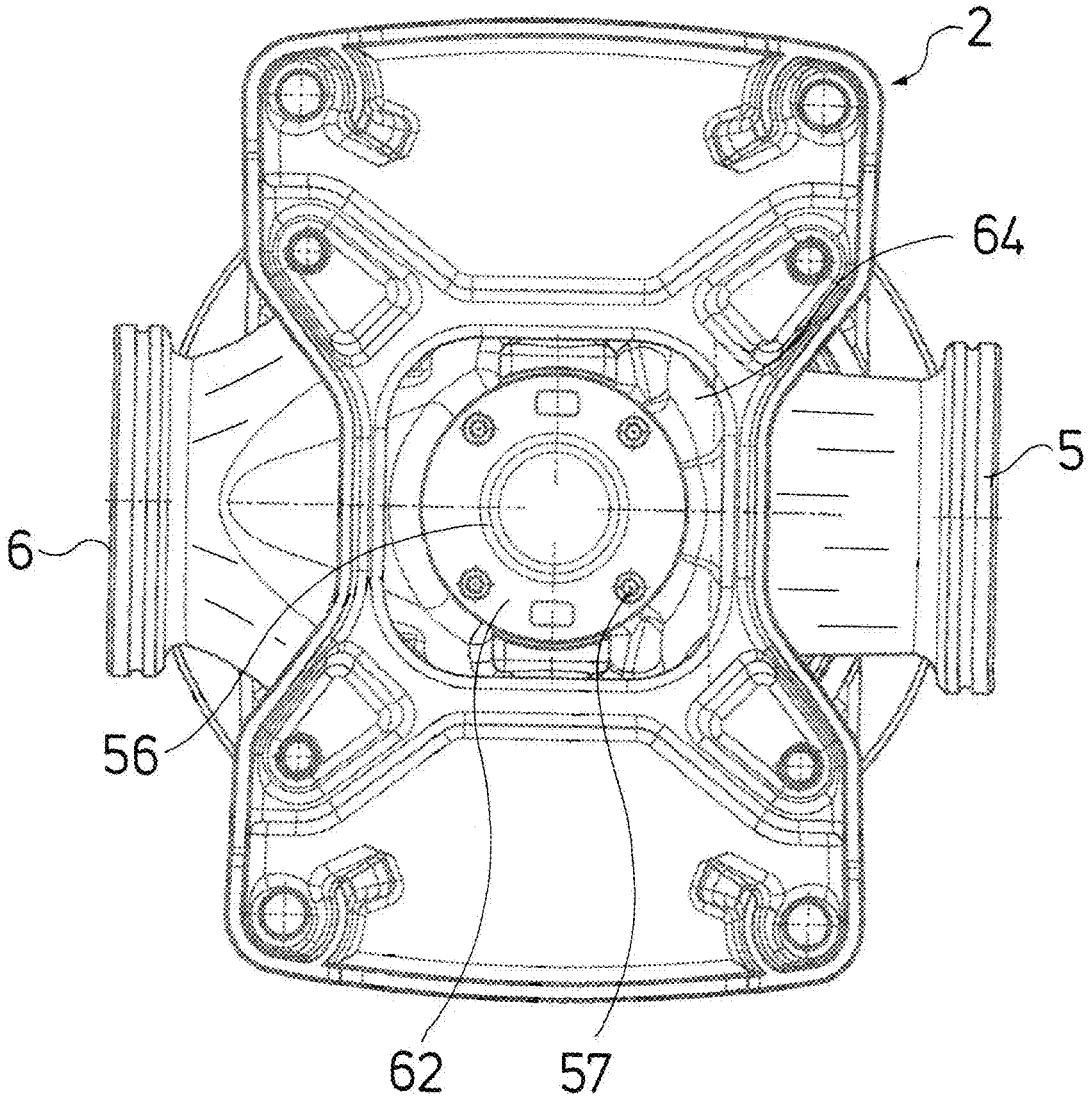
FIG. 10 is an enlarged view of the centrifugal pump from below.

As can particularly be deduced from FIG. 9, the holding ring 26 is part of a circular disc 56 which is provided for integration in a base-side maintenance opening 60 of the pump casing, here of the foot part 2. The disc 56, in a manner closing this base-side opening 60, lies in a shoulder 64 on the lower side of the foot part 2 and is releasably connected to the foot part 2 via four screws 57 which are led through recesses 61 in the edge 62 of the disc 56. An O-ring 58 which is integrated in a peripheral radial groove of the ring 26 and serves for sealing this component with respect to a recess 63 in the foot part 2, is arranged in the upper region of the ring 26, thus at a small distance to the disc 25, for sealing with respect to the foot part 2. A second O-ring 59 is integrated at an axial distance to this, in a peripheral, radial groove in the lower part of the ring 26 and serves for sealing with respect to the maintenance opening 60 in the foot part 2. A connection to the delivery side of the centrifugal pump 1 which is connected in a fluid-leading manner to the interior of the ring 26 via channels 33 in the ring 26, connects within the foot part 2, between the O-rings 58 and 59, so that the pressure of the delivery side via this connection is present at the surface of the non-rotating part 25 of the axial seal, said surface being formed by the sheet-metal section 29 and at the beginning being pressure-effective. The ring 26 via the O-ring 28 lying in a groove on the inner side of the holding ring 26 is sealed with respect to the ring 25 which forms the non-rotating part of the axial seal with the axial surface 24 of the seal. This O-ring 28 thus forms a radial seal which however only has to accommodate the comparatively small movements in the axial direction and therefore is only subjected to a low wear.

The axial seal can be overhauled and exchanged as the case may be, by way of removing the disc 56 with the holding ring 26 which is located thereon, after the screws 57 have been released, due to the fact that the pump casing at the lower side, thus in the base of the foot part 2, comprises a maintenance opening 60 which is closed by the disc 56. The shaft 38 of the pump does not have to be removed for this. All components of the axial seal which are represented in the exploded representation according to FIG. 9 can be exchanged through the opening 61 in the base of the foot part 2. An exchange of the components comprising the axial surfaces 23 and 24 as well as of the O-ring 28 is effected in the simplest case. The shaft 8 in the region of the motor stool has a cross-sectional profile which permits a locking of the shaft by way of laterally engaging a tool, in order to be able to release the threaded connections which are connected to the shaft 8. Thus the cap screw 17 can be released after the shaft 8 is held in a rotationally fixed manner by way of a spanner introduced in the region of the motor stool, and this screw can then be tightly screwed again after exchange of the rotating ring 20 and, as the case may be, further seals of the holding ring 18.

The axially stationary part of the seal, thus the non-rotating ring 25 with its seals and the holding ring 26 which with the disc 56 forms the cover for closure of the casing opening of the maintenance opening 60, together with the cover 56 are pulled out downwards and thereby the upper part of the holding ring 26 with the peripheral O-ring 58 is pulled out of the recess 63, and the lower part of the holding ring 26 with the O-ring 59 is pulled out of the maintenance opening 60. These seals as well as the O-ring 28 and the non-rotating part of the axial seal 25 can then be exchanged and together are inserted from below into the maintenance opening 60 or the recess 63 of the foot part 2, until the upper part of the holding ring 26 with the O-ring 58 sealingly bears in the recess 63 and the lower part with the O-ring 59 sealingly bears in the maintenance opening 60.

The exchange of the axial seal at the lower shaft end is described above, however it is to be understood that according to the invention, a bearing which is provided between the shaft and the casing can also be exchanged in an analogous manner, without the shaft having to change its position within the pump casing and thus extensive disassembly and assembly activities becoming necessary.

While specific embodiments of the invention have been shown and described in detail to illustrate the application of the principles of the invention, it will be understood that the invention may be embodied otherwise without departing from such principles.

APPENDIX

List of Reference Numerals

1—centrifugal pump
2—foot part
3—head part
4—jacket
5—suction connection
6—delivery connection
7—coupling
8—shaft
9—impellers
10—radial seal
11—axial seal
12—suction port
13—diffuser
14—annular channel
15—shaft end
16—pocket-hole bore
17—cap screw
18—holding ring
19—wall
20—rotating ring
21—pins
22—sleeve
23—axial surface
24—axial surface
25—non-rotating part of the axial seal, ring
26—holding ring
27—groove
28—O-ring
29—sheet-metal section
30—tongues
31—tongues
32—recesses in 29
33—channels in ring 26
34—interior of 25
35—outer thread
36—nut
37—sleeve
38—shaft
50—motor
51—motor shaft
52—recesses in ring 25
53—ends of the tongues 31
54—shoulder in ring 25
55—pin
56—disc/cover
57—screws
58—O-ring
59—O-ring
60—maintenance opening
61—bores for the screws 57
62—edge of cover
63—recess
64—shoulder in foot

What is claimed is:

1. A multistage centrifugal pump comprising:

a pump housing;

pump stage impellers, each of the stage impellers having a stage impeller outer diameter;

a shaft which carries the impellers and is rotatably arranged with one end within the pump housing and another end located at a position outside of the pump housing, wherein the one end is pressurized to compensate for axial forces acting on the shaft; and a shaft end cooperating part comprising a bearing or a seal or a bearing and a seal arranged within the pump housing on the one end of the shaft, wherein the pump housing comprises a reversibly closable maintenance opening, via which the shaft end cooperating part is accessible and is exchangeable, wherein the seal is an axial seal comprising a stationary part and a ring, which is arranged in an axially movable manner within the pump housing or within a component which is integrated therein, wherein the axial seal is accessible and removable via the reversibly closable maintenance opening, the reversibly closable maintenance opening comprising an opening outer diameter, the opening outer diameter being less than the stage impeller outer diameter, the stationary part comprising a holding ring, at least a portion of the holding ring being arranged in the maintenance opening, the holding ring comprising one more channels fluidly connecting a pressure side of the pump to an interior of the holding ring.

2. The centrifugal pump according to claim 1, wherein the holding ring comprises a screw-fastened cover, wherein the maintenance opening is closable by the screw-fastened cover, wherein the centrifugal pump is an inline pump with suction and delivery connections arranged in a base part comprising the maintenance opening, wherein the one end is pressurized to compensate for axial forces acting on the shaft via fluid delivered to a pressure side of the centrifugal pump.

3. The centrifugal pump according to claim 2, wherein the cover comprises a part which passes through the opening and receives or forms a rotationally fixed part of a seal of the bearing, the cover being externally accessible from a position outside of the centrifugal pump.

4. The centrifugal pump according to claim 2, wherein a seal of the bearing includes a part which co-rotates with the shaft that is releasably fastened on the one end of the shaft which is arranged within the pump housing.

5. The centrifugal pump according to claim 4, wherein the part of the seal of the bearing which co-rotates with the shaft is screw-fastened on the one end of the shaft.

6. The centrifugal pump according to claim 1, further comprising a motor with a motor shaft, wherein the maintenance opening is provided aligned to the motor shaft in a housing wall of the pump housing which is remote to the motor, the maintenance opening being located opposite the motor.

7. The centrifugal pump according to claim 1, wherein the shaft is arranged vertically and the maintenance opening is arranged in the base of the pump housing, the maintenance opening being arranged in an extension of the one end of the shaft.

8. The centrifugal pump according to claim 1, wherein a blocking device for blocking the shaft is provided on the another end of the shaft which extends out of the pump casing.

9. The centrifugal pump according to claim 1, wherein the holding ring comprises a cover with an overlapping portion that overlaps the maintenance opening wherein the cover is screw-fastened on the pump housing in the overlapping portion, the cover defining an outer surface of the pump housing.

10. The centrifugal pump according to claim 1, wherein the holding ring comprises a cover detachably connected to the pump housing, the cover closing the maintenance opening, wherein the cover comprises a part which passes through the opening and receives or forms a rotationally fixed part of a seal of the bearing, the part being located adjacent to the cover, the cover defining an outermost surface of the pump housing.

11. The centrifugal pump according to claim 10, further comprising a plurality of fasteners, the cover being detachably connected to the pump casing via the plurality of fasteners, the cover comprising an outer cover surface, the outer cover surface being aligned with an outer surface of the pump casing.

12. A multistage centrifugal pump comprising:

a pump housing;

pump stage impellers, each of the pump stage impellers having an impeller outer diameter;

a shaft which carries the impellers and is rotatably arranged with one end within the pump housing and another end located outside of the pump housing; and a shaft end cooperating part comprising a bearing or a seal or a bearing and a seal arranged within the pump housing on the one end of the shaft, wherein the pump housing comprises a reversibly closable maintenance opening, via which the shaft end cooperating part is accessible and is exchangeable, the reversible closable maintenance opening comprising an opening outer diameter, the opening outer diameter being less than the impeller outer diameter, the seal comprising an axial seal, the axial seal comprising a stationary part and a non-rotating seal part, the non-rotating seal part being movable in an axial direction relative to the stationary part via pressure generated from fluid delivered to the pump housing, wherein the one end of the shaft is pressurized to compensate for axial forces acting on the shaft via the fluid delivered to the centrifugal pump, the stationary part comprising a holding ring, at least a portion of the holding ring being arranged in the maintenance opening, the holding ring comprising one more channels fluidly connecting a pressure side of the centrifugal pump to an interior of the holding ring.

13. The centrifugal pump according to claim 12, wherein the centrifugal pump is an inline pump with suction and delivery connections arranged in a base part comprising the maintenance opening, wherein the fluid is delivered to the pressure side of the centrifugal pump.

14. The centrifugal pump according to claim 12, wherein the stationary part comprises a projecting portion, the non-rotating seal part comprising an opening, at least a portion of the projecting portion being arranged in the opening, the maintenance opening being located on a same side of the pump housing as the non-rotating seal part and the stationary part, the stationary part comprising an opening, the stationary part receiving fluid from a pressure side of the pump housing, the non-rotating seal part being configured to move based on the pressure in the interior of the stationary part, the pressure being generated via the fluid delivered from the pressure side of the pump housing.

15. The centrifugal pump according to claim 14, wherein the non-rotating part is movable relative to the projecting portion via the pressure generated from the fluid delivered to the pump housing, the maintenance opening being located adjacent to the non-rotating part.

16. The centrifugal pump according to claim 12, wherein the holding ring comprises a cover detachably connected to the pump housing, the cover closing the maintenance opening, wherein the cover comprises a part which passes through the opening and receives or forms a rotationally fixed part of a seal of the bearing, the part being located adjacent to the cover, the cover defining an outer surface of the pump housing.

17. The centrifugal pump according to claim 16, further comprising a plurality of fasteners and a motor, the cover being detachably connected to the pump casing via the plurality of fasteners, the cover comprising an outer cover surface, the outer cover surface being aligned with an outer surface of the pump casing, the motor being located in an interior of the pump housing at one end portion of the pump housing, the maintenance opening being located opposite the motor, the cover closing the maintenance opening in the one end portion of the pump housing.

18. A multistage centrifugal pump comprising:

a pump housing;

pump stage impellers, each of the pump stage impellers comprising an outer impeller diameter;

a shaft which carries the impellers and is rotatably arranged with a first end arranged within the pump housing and a second end arranged at a location outside of the pump housing; and a shaft end cooperating part comprising a bearing or a seal or a bearing and a seal arranged within the pump housing on the first end, wherein the pump housing comprises a reversibly closable maintenance opening, via which the shaft end cooperating part is accessible and is exchangeable, the seal comprising an axial seal, the axial seal comprising a rotating ring, a holding ring and a movable ring, the movable ring being movable relative to the holding ring in a direction of the rotating ring based on pressure generated from fluid delivered to the pump housing, the reversibly closable maintenance opening comprising an opening outer diameter, the opening outer diameter being less than the outer impeller diameter, wherein the first end is pressurized to compensate for axial forces acting on the shaft via the fluid delivered to the centrifugal pump, at least a portion of the holding ring being arranged in the maintenance opening, the holding ring comprising one more channels fluidly connecting a pressure side of the pump to an interior of the holding ring.

19. The centrifugal pump according to claim 18, wherein the centrifugal pump is an inline pump with suction and delivery connections arranged in a base part comprising the maintenance opening, the inline pump comprising the pressure side, wherein the fluid is delivered to the pressure side of the inline pump.

20. The centrifugal pump according to claim 18, wherein the holding comprises a projecting portion, the non-rotating seal part comprising an opening, at least a portion of the projecting portion being arranged in the opening, the maintenance opening being located at a same end portion of the pump housing as the non-rotating seal part and the holding ring, the interior of the holding ring being configured to receive fluid delivered to the pressure side of the pump housing, the movable ring being configured to move based on the pressure generated via the fluid in the interior of the holding ring.

* * * * *